United States Patent [19]

Glasener

[11] Patent Number: 4,813,091

[45] Date of Patent: Mar. 21, 1989

[54] CAN CLEANER DEVICE

[76] Inventor: Kenneth A. Glasener, 1 Henneberry La., Golf, Ill. 60029

[21] Appl. No.: 73,113

[22] Filed: Jul. 9, 1987

[51] Int. Cl.[4] ..... A46B 9/02

[52] U.S. Cl. ..... 15/160; 15/70; 15/104.04; 15/DIG. 5; D4/130

[58] Field of Search ..... 15/160, 70, 65, 67, 15/56, 21 A, 180, 164, 104, 104.012, 104.03, 104.04, 104.02, 97 R, 191 A, 191 R, 28, 244.1, 210 R, 211, 104.94, DIG. 5, DIG. 6; D4/130, 137, 127; D32/40, 46

[56] References Cited

U.S. PATENT DOCUMENTS

| | | | |
|---|---|---|---|
| 183,758 | 10/1876 | Furter | 15/160 |
| 490,682 | 1/1893 | Roemer | 15/191 R |
| 1,362,822 | 12/1920 | Rude | 15/70 |
| 2,021,608 | 11/1935 | Petty | 15/180 |

FOREIGN PATENT DOCUMENTS

| | | | |
|---|---|---|---|
| 453012 | 11/1927 | Fed. Rep. of Germany | 15/65 |
| 39918 | 6/1907 | Switzerland | 15/DIG. 5 |
| 2470 | of 1904 | United Kingdom | 15/164 |

*Primary Examiner*—Peter Feldman

*Attorney, Agent, or Firm*—McDermott, Will & Emery

[57] ABSTRACT

A can cleaning device including a base having a cylindrical cross-section and an integral side wall to form a cavity for receiving the top of a can. A cleaning material is affixed to the base within the cavity to scrub the top of a can through manual manipulation of the device.

1 Claim, 1 Drawing Sheet

CAN CLEANER DEVICE

BACKGROUND OF THE INVENTION

1. Field of the Invention

The present invention relates to cleaning implements and, more particularly, to a cleaning device for scrubbing or otherwise cleaning the top of a can or similar article.

2. Description of the Prior Act

Beverages and other food items are commonly packaged in cylindrical cans. During transport and storage dirt, and other unsanitary substances are prone to accumulate on the lid or the can. Such contaminants are easily transferred to a person consuming the beverage and the like through direct contact with the consumer's mouth or even during transfer of the can contents to a glass or the other utensel. Simple wiping of a lid by a cloth and the like does not attain suitable cleaning, particularly in view of the structural protrusions created by the protruding rim of the can and the groove commonly formed on known lid designs. No prior cleaning technique has been developed permitting effective and convenient cleaning of a lid of a can prior to use by the consumer.

SUMMARY OF THE INVENTION

It is an objective of the invention to provide an inexpensive and effective device for scrubbing and otherwise cleaning the lid of a beverage can or a similar container. The device of the invention is portable, inexpensive and simple to use in removing the build-up of foreign substances from the lid prior to consumption.

The device herein disclosed includes a base having a circular configuration and an intergral concentric side wall forming a cavity for receiving the top of a can. The side wall is tapered to facilitate easy positioning on the can. The base supports novel cleaning means in the cavity to scrub the usually irregular surface contours of the lid. By simple manipulation, the device dislodges foreign material for ready removal.

DESCRIPTION OF A PREFERRED EMBODIMENT

Figure 1:
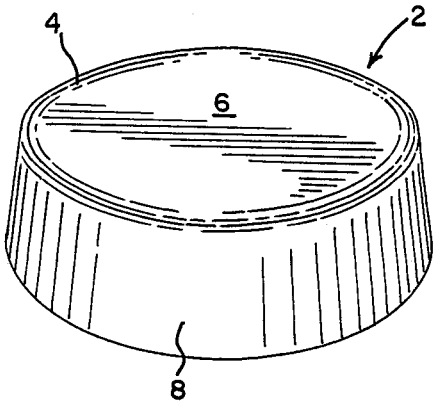
FIG. 1 is a front perspective view of the can cleaning device of the invention.

Referring now to FIGS. 1 to 4, there is illustrated the can cleaning device of the invention generally designated by reference numeral 2. The can cleaning device 2 includes a body 4 comprising a base 6 having a cylindrical cross-section. A continuous tubular-like wall 8 is integrally formed on the peripheral portion of base 6. The body 4 may be molded or otherwise fabricated from a suitable material, such as a plastic and the like. The base 6 and side wall 8 form a can receiving cavity 10 by which the body 4 can be positioned over the top of a can 12 of numerous designs, such as a twelve or sixteen ounce beverage can, as partially shown in FIG. 2. The side wall 8 is tapered outward to facilitate easy "lead-in" of the body 4 to the can top. The width of the base 6 has a high tolerance to fit a wide range of can tops. The height of side wall 8 is arbitrary.

Figure 2:
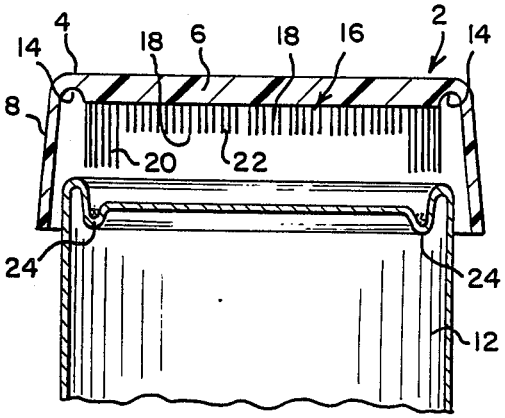
FIG. 2 is a side elevational view, with parts in section, of the can cleaning device of FIG. 1 in contact with a portion of a can to be cleaned.
Figure 3:
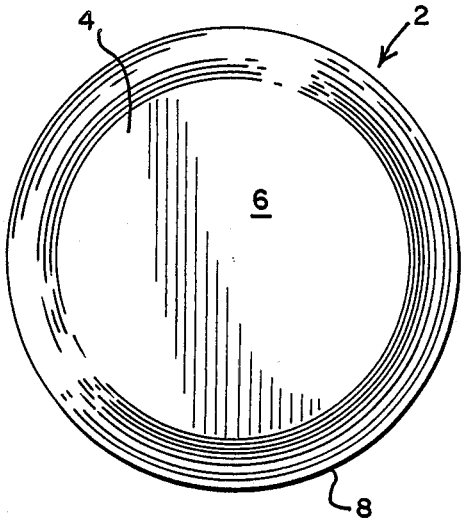
FIG. 3 is a top plan view of the can cleaner of FIG. 1.

As seen in FIG. 2, base 6 is formed with a greater thickness than side wall 8 except at its peripheral portion at which the thickness of the base is reduced down to form a continuous groove 14. A suitable cleaning material 16 is affixed to the inside face of base 6 to provide a scrubbing or abrasive agent for contact with the lid of the can 12. Although other cleaning agents, such as a sponge, fabric, and the like, may be employed in the invention, the cleaning material 16 is shown as bristles 18 suitable affixed to base 6 by an adhesive and the like.

Figure 4:
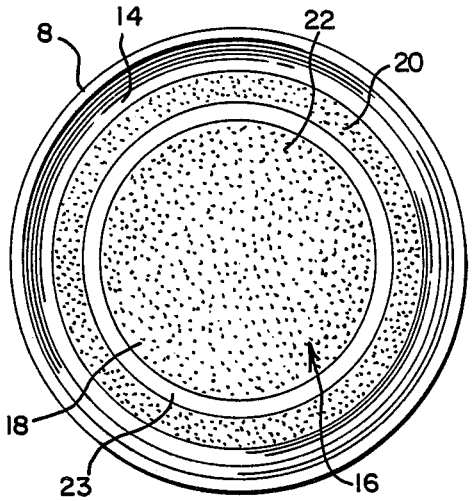
FIG. 4 is a bottom plan view of the can cleaner of FIG. 1.

As shown in FIGS. 2 and 4, the outer bristles 20 are concentrically arranged and have a longer length than the shorter bristles 22 situated centrally within bristles 20. The bristles 20 may also be stiffer than central bristles 22. The increased length and stiffness of bristles 20 insure that the grove 24 (FIG. 2) typically found on the lid of can 12 can be adequately cleaned, while the bristles 22 can scrub the remaining portions of the lid. The bristles 20 and 22 may be separated by a spacing 23, if desired.

In use, the body 4 is applied to the top of a can to be cleaned. The groove 14 serves to engage the can rim to center the cleaning material on the lid of the can 12. The long bristles 20 reached into the groove 24 and bristles 22 contact the remainder of the lid, while the body 4 is manually rotated or oscillated. Vigorous motion of body 4 thereby scrubs the lid for sanitary cleaning of the can prior to consumption of its contents. After cleaning the can, the device 2 can be removed and the lid may be rinsed under water if desired. The lid cleaning device 2 may clean the can with or without being moistened and optionally in the presence of soap or other cleaning substance.

What I claim is:

1. A can cleaning device for cleaning the top of a conventional pop top can including a top, a peripheral rim and a circular groove adjacent thereto, comprising:

a generally circular shaped body forming a cavity in which the end of a pop top can can be positioned, said body including a generally circular base portion and an integral frusto-conically shaped side wall formed on the periphery of said base and depending downwardly therefrom, said frusto-conical side wall portion having an internal diameter larger than said can rim at its lower, open end, so that the interior of said side wall portion acts as a guide means to engage the rim of the can and center the cleaning device on the can top; and cleaning means in the form of a plurality of bristles extending downwardly form said body means within the cavity, said bristles comprising a plurality of sets of bristle portions including a first set of said bristle portions arranged in an annular ring generally adjacent said peripheral side wall to engage and clean the perimeter groove of the pop top can the length of said first set of bristles extending downwardly in length approximately one-half the height of the peripheral side wall and a second generally circular shaped set of bristle portion on the interior of said first annular shaped set, said second set of bristles being substantially shorter than said first set for engaging and cleaning the portion of the pop top can interior to its peripheral grooves.

* * * * *